US010741146B2

(12) United States Patent
Song et al.

(10) Patent No.: US 10,741,146 B2
(45) Date of Patent: Aug. 11, 2020

(54) ELECTROLUMINESCENT DISPLAY SCREEN AND BRIGHTNESS UNIFORMITY COMPENSATION METHOD AND SYSTEM THEREOF

(71) Applicant: BOE TECHNOLOGY GROUP CO., LTD., Beijing (CN)

(72) Inventors: Danna Song, Beijing (CN); Song Meng, Beijing (CN); Mingi Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 155 days.

(21) Appl. No.: 15/771,937

(22) PCT Filed: Sep. 20, 2017

(86) PCT No.: PCT/CN2017/102480
§ 371 (c)(1),
(2) Date: Apr. 27, 2018

(87) PCT Pub. No.: WO2018/157582
PCT Pub. Date: Sep. 7, 2018

(65) Prior Publication Data
US 2019/0385568 A1 Dec. 19, 2019

(30) Foreign Application Priority Data
Mar. 1, 2017 (CN) ..... 2017 1 0118476

(51) Int. Cl.
*G09G 3/30* (2006.01)
*G09G 5/10* (2006.01)
(Continued)

(52) U.S. Cl.
CPC ..... *G09G 5/10* (2013.01); *G09G 3/3258* (2013.01); *G09G 3/3291* (2013.01); *G09G 2320/0233* (2013.01); *G09G 2320/0633* (2013.01)

(58) Field of Classification Search
CPC ..... G09G 2310/027; G09G 2310/08; G09G 2320/0233; G09G 2320/0295;
(Continued)

(56) References Cited

U.S. PATENT DOCUMENTS 8,519,917 B2 8/2013 Ryu et al.
2009/0184903 A1* 7/2009 Kwon ..... G09G 3/3225 345/80
(Continued)

FOREIGN PATENT DOCUMENTS

CN 101933074 A 12/2010
CN 103165076 A 6/2013
(Continued)

OTHER PUBLICATIONS

First Office Action for CN Application No. 201710118476.9, dated Jun. 23, 2018.
(Continued)

*Primary Examiner* — Insa Sadio
(74) *Attorney, Agent, or Firm* — Dinsmore & Shohl LLP

(57) ABSTRACT

The present disclosure discloses an electroluminescent display screen and brightness uniformity compensation method and system thereof, wherein the method comprises: performing test modeling based on a correspondence between an aging rule of an electroluminescent diode in the display screen and an aging rule of a thin film transistor (TFT) in the display screen to acquire a brightness uniformity compensation model; acquiring a first compensation parameter and a second compensation parameter required for compensat-
(Continued)

ing the TFT, and acquiring a current brightness ratio of the electroluminescent diode through invoking the brightness uniformity compensation model based on the compensation parameters; performing brightness uniformity compensation on the display screen based on the acquired current brightness ratio of the electroluminescent diode.

5 Claims, 4 Drawing Sheets

(51) Int. Cl.
*G09G 3/3258* (2016.01)
*G09G 3/3291* (2016.01)

(58) Field of Classification Search
CPC ..... G09G 2320/043; G09G 2320/045; G09G 2320/0626; G09G 2320/0693; G09G 2330/12; G09G 2360/141; G09G 2360/147; G09G 3/006; G09G 3/2074; G09G 3/3233; G09G 3/3258
See application file for complete search history.

(56) References Cited

U.S. PATENT DOCUMENTS

2012/0086694 A1* 4/2012 Tseng ..... G09G 3/3233 345/212
2015/0243216 A1 8/2015 Chung et al.

FOREIGN PATENT DOCUMENTS

| | | | |
|---|---|---|---|
| CN | 103295485 | A | 9/2013 |
| CN | 103617776 | A | 3/2014 |
| CN | 104599632 | U | 5/2015 |
| CN | 104809986 | U | 7/2015 |
| CN | 105096834 | A | 11/2015 |
| CN | 105529002 | A | 4/2016 |
| CN | 105895056 | A | 8/2016 |
| CN | 106847175 | A | 6/2017 |

OTHER PUBLICATIONS

International Search Report and Written Opinion for PCT/CN2017/102480, dated Dec. 27, 2017.

* cited by examiner

ELECTROLUMINESCENT DISPLAY SCREEN AND BRIGHTNESS UNIFORMITY COMPENSATION METHOD AND SYSTEM THEREOF

CROSS-REFERENCE TO RELATED APPLICATIONS

The present application is a U.S. National Stage under 35 U.S.C. § 371 of International Application No. PCT/CN2017/102480, as filed on Sep. 20, 2017, which claims the benefit of priority to Chinese Patent Application No. 201710118476.9, filed on Mar. 1, 2017. The disclosure of each application is incorporated herein by reference in entirety.

TECHNICAL FIELD

The present disclosure relates to brightness uniformity compensation method and system of an electroluminescent display screen and an electroluminescent display screen.

BACKGROUND ART

Each of the sub-pixels constituting the electroluminescent display screen includes an electroluminescent diode composed of a light emitting layer between an anode and a cathode, and a pixel circuit for independently driving the electroluminescent diode. The pixel circuit mainly comprises switching TFTs (Thin Film Transistor), capacitors and driving TFTs. The switching TFT charges a voltage corresponding to a data signal to the capacitor in response to a scan pulse, and the driving TFT controls a magnitude of a current supplied to the electroluminescent diode based on a magnitude of the voltage charged to the capacitor, thereby adjusting a brightness of the electroluminescent diode, wherein the brightness of the electroluminescent diode is proportional to the current supplied by the driving TFT.

SUMMARY

An embodiment of a first aspect of the present disclosure proposes a brightness uniformity compensation method of an electroluminescent display screen, comprising the following steps: performing test modeling based on a correspondence between an aging rule of an electroluminescent diode in the display screen and an aging rule of a thin film transistor (TFT) in the display screen to construct a brightness uniformity compensation model; acquiring a first compensation parameter and a second compensation parameter required for compensating the TFT, and acquiring a current brightness ratio of the electroluminescent diode through invoking the brightness uniformity compensation model based on the first compensation parameter and the second compensation parameter required for compensating the TFT; and performing brightness uniformity compensation on the display screen based on the acquired current brightness ratio of the electroluminescent diode.

The brightness uniformity compensation method of an electroluminescent display screen according to an embodiment of the present disclosure firstly performs the detection of the compensation parameters and brightness ratio on the display screen, constructs a brightness uniformity compensation model based on the detected data, and then performs brightness uniformity compensation on the display screen based on the brightness uniformity compensation model. In this way, the brightness uniformity compensation effect of the display screen may be improved and the brightness uniformity of the display screen may be improved.

According to some embodiments of the present disclosure, an aging treatment is performed on the display screen in a state of performing electrical compensation on the display screen to construct the brightness uniformity compensation model, wherein process of constructing the brightness uniformity compensation model comprises: before the aging treatment is performed on the display screen, detecting and recording a first compensation parameter VGS1t0 and a second compensation parameter VGS2t0 of each sub-pixel in the display screen, and measuring and recording a brightness ratio Lt0 of the display screen after the electrical compensation is performed; after the aging treatment is performed on the display screen, measuring and recording the brightness ratio L of the display screen every first preset time, updating electrical compensation data to obtain a first compensation parameter VGS1tn and a second compensation parameter VGS2tn, and measuring and recording a brightness ratio Ltn of the display screen after electrical compensation is performed based on the updated electrical compensation data; and constructing the brightness uniformity compensation model based on the first compensation parameter VGS1t0 and the second compensation parameter VGS2t0, the brightness ratio Lt0, the first compensation parameter VGS1tn and the second compensation parameter VGS2tn, and the brightness ratio Ltn, where n is an integer greater than or equal to 1.

According to some embodiments of the present disclosure, brightness uniformity compensation is performed on the display screen based on the acquired current brightness ratio of the electroluminescent diode, comprising: compensating for the measured brightness ratio L of the display screen based on the acquired current brightness ratio of the electroluminescent diode to perform brightness uniformity compensation on the display screen.

According to some embodiments of the present disclosure, when performing electrical compensation on the display screen, a voltage VGS that needs to be output for each sub-pixel is calculated by the following formula:

$$VGS = \left(\frac{GL}{1023}\right)^{1.1}(2VGS1 - 2VGS2) + (2VGS2 - VGS1),$$

wherein GL is an input gray scale, and VGS1 and VGS2 are a first compensation parameter and a second compensation parameter respectively required for electrical compensation.

An embodiment of a second aspect of the present disclosure proposes a brightness uniformity compensation system of an electroluminescent display screen, comprising: a modeling module for performing test modeling based on a correspondence between an aging rule of an electroluminescent diode in the display screen and an aging rule of a thin film transistor (TFT) in the display screen, so as to obtain a brightness uniformity compensation model; and an acquisition module for acquiring a first compensation parameter and a second compensation parameter required for compensating the TFT, and for acquiring a current brightness ratio of the electroluminescent diode through invoking the brightness uniformity compensation model based on the first compensation parameter and the second compensation parameter required for compensating the TFT; and a brightness compensation module for performing brightness uniformity compensation on the display screen based on the acquired current brightness ratio of the electroluminescent diode.

The brightness uniformity compensation system of the electroluminescent display screen of an embodiment of the present disclosure firstly performs test modeling through a modeling module based on a correspondence between the aging rule of the electroluminescent diode in the display screen and the aging rule of the thin film transistor TFT in the display screen, so as to obtain a brightness uniformity compensation model, then acquires a first compensation parameter and a second compensation parameter required for compensating the TFT through an acquisition module, acquires a current brightness ratio of the electroluminescent diode through invoking the brightness uniformity compensation model based on the first compensation parameter and the second compensation parameter required for compensating the TFT, and at last performs brightness uniformity compensation on the display screen through a brightness compensation module based on the acquired current brightness ratio of the electroluminescent diode. Thus, the effectiveness of brightness uniformity compensation of the display screen may be improved, and the brightness uniformity of the display screen may be improved.

According to some embodiments of the present disclosure, the modeling module is specifically used to construct the brightness uniformity compensation model while an electrical compensation circuit is compensating the display screen, wherein the process that the modeling module constructs the brightness uniformity compensation model comprises: before the aging treatment is performed on the display screen, detecting and recording a first compensation parameter VGS1t0 and a second compensation parameter VGS2t0 of each sub-pixel in the display screen, and measuring and recording a brightness ratio Lt0 of the display screen after the electrical compensation is performed; after the aging treatment is performed on the display screen, measuring and recording a brightness ratio L of the display screen every first preset time, and updating electrical compensation data to obtain a first compensation parameter VGS1tn and a second compensation parameter VGS2tn, and measuring and recording a brightness ratio Ltn of the display screen after the electrical compensation is performed based on the updated electrical compensation data; constructing the brightness uniformity compensation model based on the first compensation parameter VGS HO and the second compensation parameter VGS2t0, the brightness ratio Lt0, the first compensation parameter VGS1tn and the second compensation parameter VGS2tn, and the brightness ratio Ltn, where n is an integer greater than or equal to 1.

According to some embodiments of the present disclosure, when performing brightness uniformity compensation on the display screen based on the acquired current brightness ratio of the electroluminescent diode, the brightness compensation module further compensates for the measured brightness uniformity L of the display screen based on the acquired current brightness ratio of the electroluminescent diode, so as to perform brightness uniformity compensation on the display screen.

According to some embodiments of the present disclosure, when the electrical compensation circuit performs electrical compensation on the display screen, a voltage VGS that needs to be output for each sub-pixel is calculated by the following formula:

$$VGS = \left(\frac{GL}{1023}\right)^{1.1}(2VGS1 - 2VGS2) + (2VGS2 - VGS1)$$

wherein GL is an input gray scale, and VGS1 and VGS2 are the first compensation parameter and the second compensation parameter respectively required for electrical compensation.

Further, an embodiment of a third aspect of the present disclosure proposes an electroluminescent display screen comprising the brightness uniformity compensation system described above.

DETAILED DESCRIPTION

Figure 1:
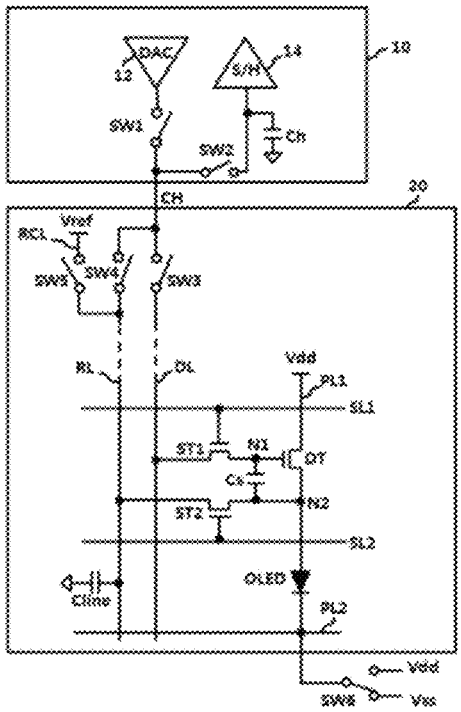
FIG. 1 is a circuit diagram of a local structure of a display device for pixel current sensing of the related art.

Embodiments of the present disclosure are described in details below, examples of which are illustrated in the accompanying drawings, in which the same or similar reference numerals denote the same or similar elements or elements having the same or similar functions throughout. The embodiments described below with reference to the accompanying drawings are exemplary and are intended to explain the present disclosure, but should not be construed as limitations of the present disclosure.

In an electroluminescent display screen, threshold voltages Vth and mobilities of driving TFTs between each sub-pixel have a characteristic difference due to a process deviation or the like, so that magnitudes of currents for driving the electroluminescent diode are different. Therefore, a deviation in brightness will occur between the sub-pixels. In general, the originally generated characteristic differences of the driving TFTs result in spots or patterns on the screen, whereas the characteristic differences caused by degradation of the driving TFTs generated when driving the electroluminescent diodes reduce a lifetime of the electroluminescent display screen, or makes the electroluminescent display screen produce a residual image.

In order to solve this problem, an organic light emitting diode display device for pixel current sensing and a pixel current sensing method thereof are proposed in the related art. As shown in FIG. 1, this technique utilizes a parasitic capacitance on column lines on the display screen and charges the parasitic capacitance using a current of the driving TFT, inputs the charged voltage to an analog-to-digital conversion (ADC) module, and then uses the formula I=Cx(V2−V1)/(t2−t1) to calculate the current of the driving TFT. However, due to the limitations of the process (e.g., film thickness uniformity, etc.), the effect of this compensation method is not ideal, especially in a case of low gray levels.

In view of the above, the present disclosure provides brightness uniformity compensation method and system of an electroluminescent display screen and an electroluminescent display screen.

The brightness uniformity compensation method and system of an electroluminescent display screen and the electroluminescent display screen according to embodiments of the present disclosure are described below with reference to the accompanying drawings.

Figure 2:
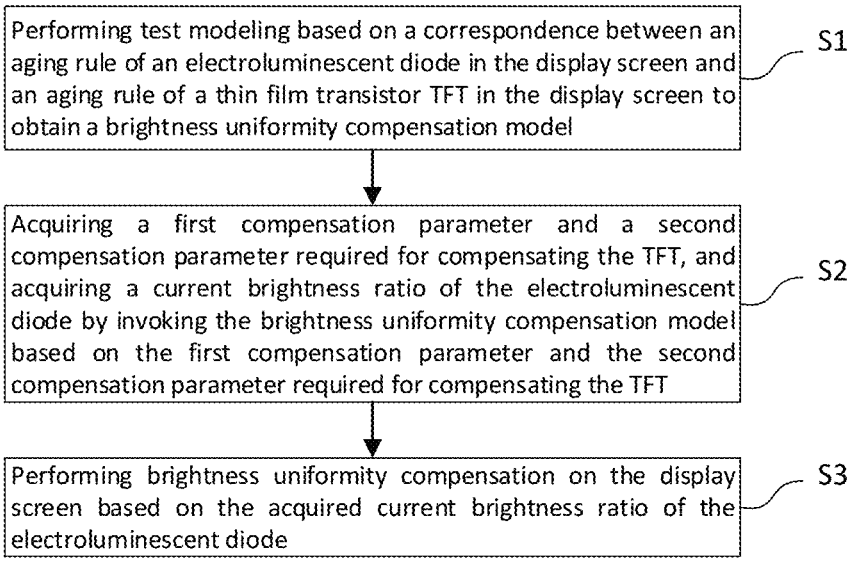
FIG. 2 is a flowchart of a brightness uniformity compensation method of an electroluminescent display screen according to some embodiments of the present disclosure.

FIG. 2 is a flowchart of a brightness uniformity compensation method of an electroluminescent display screen according to one embodiment of the present disclosure. As shown in FIG. 2, the brightness uniformity compensation method may comprise the following steps:

S1, performing test modeling based on a correspondence between the aging rule of the electroluminescent diode in the display screen and the aging rule of the thin film transistor TFT in the display screen to obtain a brightness uniformity compensation model.

In one embodiment of the present disclosure, an aging treatment may be performed on the display screen in a state of performing electrical compensation on the display screen to obtain a brightness uniformity compensation model. The electrical compensation reduces the number of sense channels, and uses four sub-pixels to share one sense line in order to reduce the number of Source ICs.

Specifically, when performing electrical compensation on the display screen, a voltage VGS that needs to be output to each sub-pixel can be calculated by the following formula (1):

$$VGS = \left(\frac{GL}{1023}\right)^{1.1}(2VGS1 - 2VGS2) + (2VGS2 - VGS1) \quad (1)$$

wherein GL is an input gray scale, and VGS1 and VGS2 are a first compensation parameter and a second compensation parameter required for electrical compensation respectively, and they may be voltage values when the TFT is at two certain specific currents respectively.

According to formula (1), it can be known that when the first compensation parameter VGS1 and the second compensation parameter VGS2 required for electrical compensation are detected, a drive voltage value VGS needing to be compensated for can be calculated to thereby be feedback to the driver chip to realize compensation. For this reason, in the embodiment of the present disclosure, a driver chip having a function of detecting a voltage may be designed in the display screen to detect a first compensation parameter and a second compensation parameter required for electrical compensation.

Figure 3:
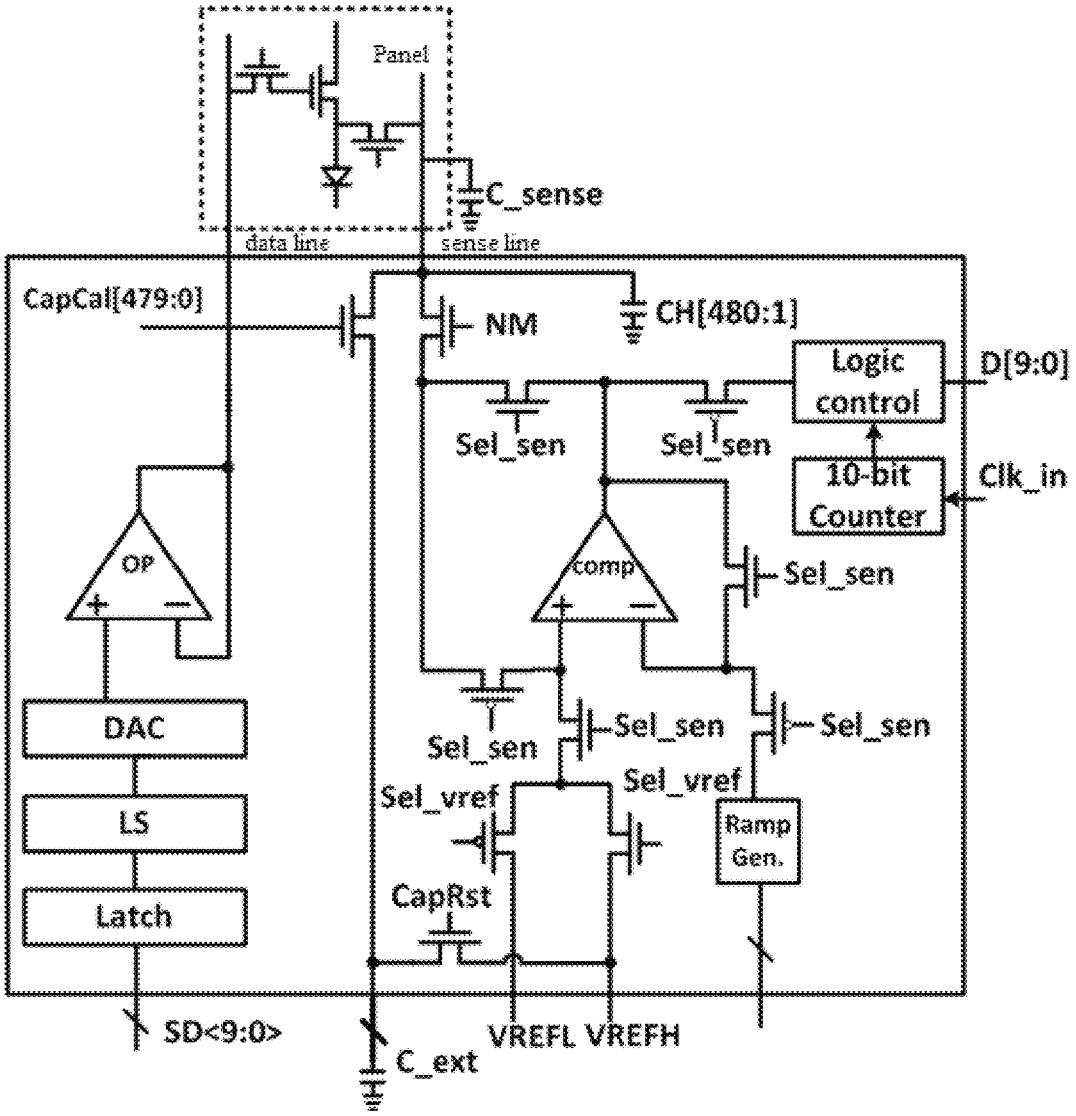
FIG. 3 is a circuit diagram for electrical compensation detection according to some examples of the present disclosure.

In an example of the present disclosure, as shown in FIG. 3, taking the pixel circuit of 3T1C (three transistors and 1 capacitor) as an example, a first compensation parameter and a second compensation parameter required when the driver chip detects the electrical compensation are described in the following contents:

As shown in FIG. 3, an OP (Operational Amplifier) of the Sense line can be reused as a comparator, and an amplifier or comparator function can be selected through a control signal Sel_sen. When the OP is used as an amplifier, Sel_sen is at high level and can output a high reference voltage or a low reference voltage through Sel_vref control. When the OP is used as a comparator, Sel_sen is at low level.

Figure 4:
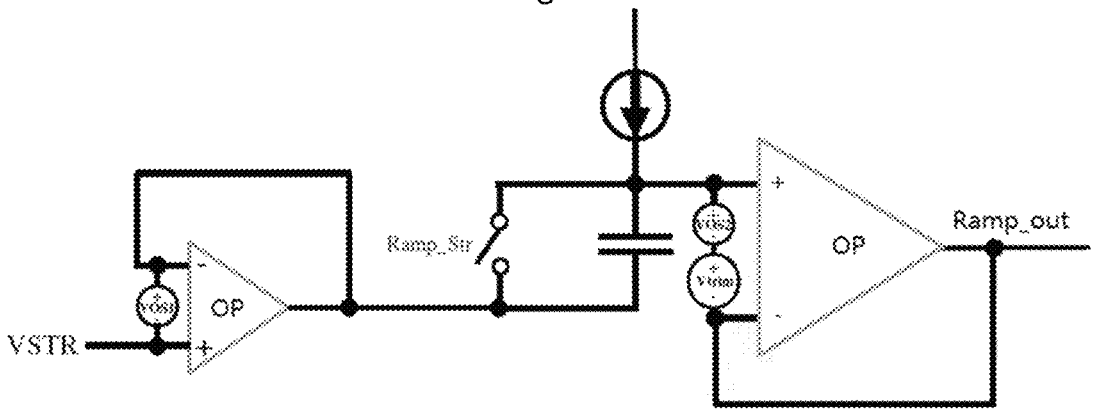
FIG. 4 to FIG. 5 are circuit diagrams of a ramp voltage unit shown in FIG. 3.
Figure 5:
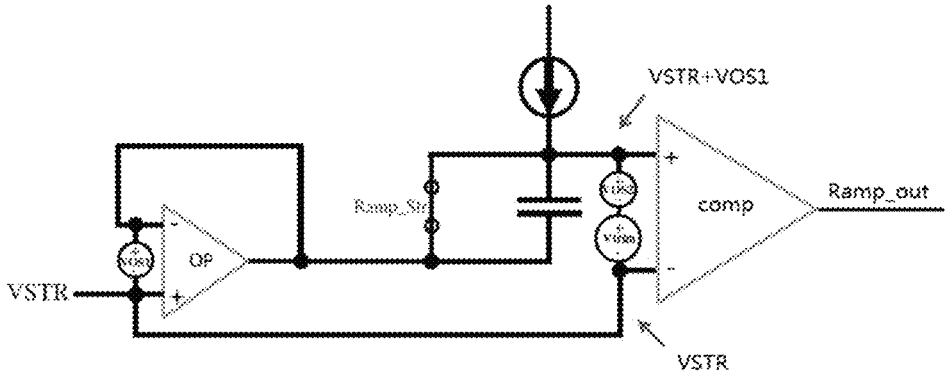

The ramp voltage unit Ramp in FIG. 3 can be implemented by charging a capacitor with a precision current source. Specifically, as shown in FIG. 4 and FIG. 5, VSTR is a ramp start voltage input from outside, which is connected to one end of the capacitor via an output of a first stage OP, and the other end of the capacitor is connected to an anode of a second stage OP. Meanwhile, a switch Ramp_Str is provided at both ends of the capacitor. When resetting the capacitor, the switch Ramp_Str is closed, so that a voltage across the capacitor is VSTR, then the switch Ramp_Str is open, and a ramp voltage is obtained by charging the capacitor with a current.

When the VSTR passes through the first stage OP, an OP offset voltage VOS1 is introduced, and the OP of the ramp voltage can also be reused as a comparator to calibrate offset voltages of the first stage OP and the second stage OP. A calibration voltage Vtrim is added to the positive and negative poles of the second stage OP. When VOS1−(VOS2+Vtrim) is positive, the output Ramp_out is a high voltage; and when VOS1−(VOS2+Vtrim) is negative, the output Ramp_out is a low voltage. The value of Vtrim can be changed, and when its output changes from low to high or from high to low, it can be considered that VOS1 and VOS2 are just calibrated. As shown in FIG. 3, a capacitor CH is added in each channel to reduce an effect of external noise on the voltage. A common capacitor C_ext (which has a capacitance similar to C_sense) is externally added to the driver chip and is used for charge sharing with the sense line capacitor in the panel to calibrate the sense line capacitance, and both G1 and G2 are open during calibration.

Specifically, a switching transistor NM is firstly turned on, the sense lines are all reset to a low reference voltage VREFL through the OP of the sense line, and a voltage of the C_ext capacitor is reset to VREFH. Then, switches of each channel and the capacitor C_ext are turned on one by one, and charge sharing with the capacitor C_ext is performed in turn, wherein the capacitor C_ext needs to be reset before charge sharing is performed. Finally, a voltage assigned to each channel is compared with a ramp voltage, and a resulting value is output, where C_ext*VREFH=(C_ext+Csense)*Vout, and Vout is the aforementioned output value. Thus, the sense line capacitance is calibrated.

Further, Sel_sen is set to be at high level, so that the sense line outputs a voltage VREFL, while a voltage Vdata is output through the data line, so that a gate-source voltage of the TFT is equal to Vdata-VREFL, and the sense line is charged. Before the electrical compensation is performed, two target voltages of the sense line are set. By adjusting an output voltage of the data line, the voltage of the sense line gradually approaches the set target voltages. When the voltage of the sense line reaches two target voltages, respectively, the corresponding voltages of the data line are recorded as a first compensation parameter VGS1 and a second compensation parameter VGS2, respectively.

It should be noted that when the display screen is subjected to an aging treatment, the compensation state is not limited to the above-mentioned electrical compensation state, but may also be an optical compensation state, an internal compensation state, or the like.

Figure 6:
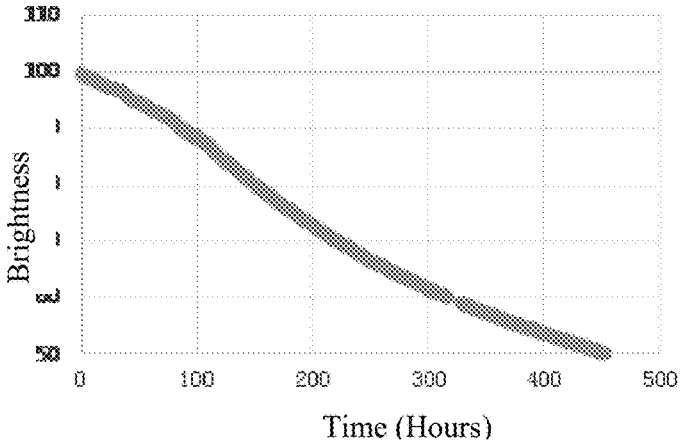
FIG. 6 is a brightness ratio-time graph of an electroluminescent display screen according to some examples of the present disclosure.

It can be understood that, when performing the aging treatment on the display screen, the brightness of the display screen is related to a lighting time of the display screen. As shown in FIG. 6, the longer the lighting time of the display screen is, the lower the brightness of the display screen is. It should be noted that the vertical axis in FIG. 6 represents a ratio of the brightness of the electroluminescent display screen being aged to the initial brightness of the electroluminescent display screen.

It can be understood that there is a correspondence between an aging degree of the electroluminescent diode in the display screen and an aging degree of the thin film transistor TFT. That is, there is a correspondence between the first compensation parameter and the second compensation parameter required for compensating the TFT during the electrical compensation and the brightness ratio, and the correspondence is a brightness uniformity compensation model.

S2, acquiring the first compensation parameter and the second compensation parameter required for compensating the TFT, and acquiring a current brightness ratio of the electroluminescent diodes by invoking the brightness uniformity compensation model based on the first compensation parameter and the second compensation parameter required for compensating the TFT.

S3, performing brightness uniformity compensation on the display screen based on the acquired current brightness ratio of the electroluminescent diodes.

Specifically, the first compensation parameter and the second compensation parameter required for compensating the TFT during the electrical compensation can be detected through a driver chip structure shown in FIG. 3. Further, a current brightness ratio of the electroluminescent diode can be obtained by invoking the brightness uniformity compensation model based on the first compensation parameter and the second compensation parameter required for compensating the TFT. Furthermore, brightness uniformity compensation is performed on the display screen based on the brightness ratio, and a similar operation is performed on all the sub-pixels.

The brightness uniformity compensation method of the electroluminescent display screen provided by the embodiments of the present disclosure firstly performs test modeling based on a correspondence between the aging rule of the diode in the display screen and the aging rule of the thin film transistor TFT in the display screen to acquire a brightness uniformity compensation model, and then acquires a first compensation parameter and a second compensation parameter required for compensating the TFT, acquires a current brightness ratio of the electroluminescent diode through invoking the brightness uniformity compensation model based on the compensation parameters, and at last performs brightness uniformity compensation on the display screen based on the acquired current brightness ratio of the electroluminescent diode. Thus, the effectiveness of the brightness uniformity compensation of the display screen may be improved, and the brightness uniformity of the display screen may be improved.

It should be noted that, in the embodiments of the present disclosure, in the process of constructing a brightness uniformity compensation model, non-real-time electrical compensation is used, i.e., electrical compensation updating is not performed when the display screen is lighted up, and updating of electrical compensation data is performed after the display screen is turned off. When the display screen works to compensate the display screen based on the brightness uniformity compensation model, a first compensation parameter and a second compensation parameter required for compensating the TFT during the real-time electrical compensation are acquired through the driver chip.

Figure 7:
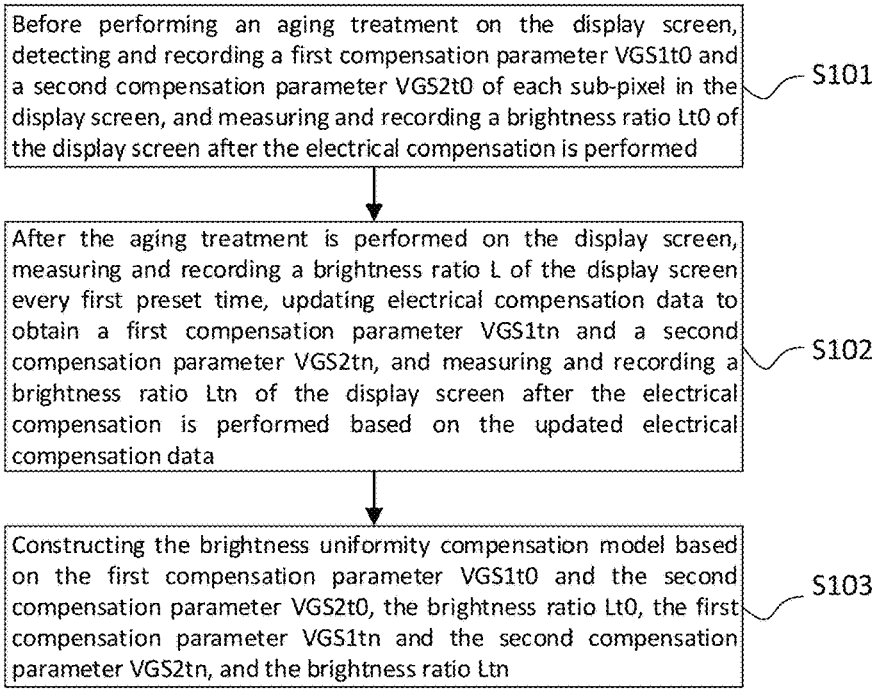
FIG. 7 is a specific flowchart of step S1 in the brightness uniformity compensation method of the electroluminescent display screen according to some embodiments of the present disclosure.

Further, in an embodiment of the present disclosure, as shown in FIG. 7, the process of constructing a brightness uniformity compensation model in step S1 may comprise the following steps:

S101, before an aging treatment is performed on the display screen, detecting and recording a first compensation parameter VGS HO and a second compensation parameter VGS2t0 of each sub-pixel in the display screen, and measuring and recording a brightness ratio Lt0 of the display screen after the electrical compensation is performed.

It can be understood that the brightness ratio Lt0 of the display screen after the electrical compensation is a ratio between a brightness of the display screen after the electrical compensation is performed and an initial brightness of the display screen, and the value thereof may range from 50% to 100%.

In the embodiments of the present disclosure, an imaging brightness meter (such as a multi-color brightness meter, etc.) and a brightness meter with light-blocking barrel may be used when measuring the brightness of the display screen. A pixel grayscale measurement system using a CCD (Charge-coupled Device) may also be used, i.e., an image of the display screen is captured by the CCD, and then the image is processed by the image processing technology to extract a gray value of each pixel of the display screen, so as to obtain a relative brightness value of each pixel in the display screen. A brightness meter using the CCD technology may also be used, that is, gather grayscale data of the display screen using the CCD. The method can measure brightness source with large area, has good real-time performance, and can obtain a large amount of information.

S102, after the aging treatment is performed on the display screen, measuring and recording a brightness ratio L of the display screen every first preset time, updating electrical compensation data to obtain a first compensation parameter VGS1tn and a second compensation parameter VGS2tn, and measuring and recording a brightness ratio Ltn of the display screen after the electrical compensation is performed based on the updated electrical compensation data.

Specifically, the display screen is aged in an electrical compensation state. After detecting and recording the first compensation parameter VGS HO and the second compensation parameter VGS2t0 of each sub-pixel in the display screen, the display screen is lighted up for the first preset time t1 for the first time, the brightness ratio L1 of the display screen is detected and recorded, and the first compensation parameter VGS1t1 and the second compensation parameter VGS2t1 at this moment are recorded, while the electrical compensation data is updated according to the above formula (1). After updating the compensation, the brightness of the display screen is measured again and the brightness ratio Lt1 of the display screen at this moment is recorded.

In the same manner, the display screen is lighted up for the first preset time t1 for the nth time, the brightness ratio Ln of the display screen is detected and recorded, and the first compensation parameter VGS1tn and the second compensation parameter VGS2tn at this moment are recorded, while the electrical compensation data is updated according to the above formula (1). After updating the compensation, the brightness ratio Ltn of the display screen at this moment is measured again and recorded.

S103, constructing the brightness uniformity compensation model based on the first compensation parameter VGS HO and the second compensation parameter VGS2t0, the brightness ratio Lt0, the first compensation parameter VGS1tn and the second compensation parameter VGS2tn, and the brightness ratio Ltn.

Figure 8:
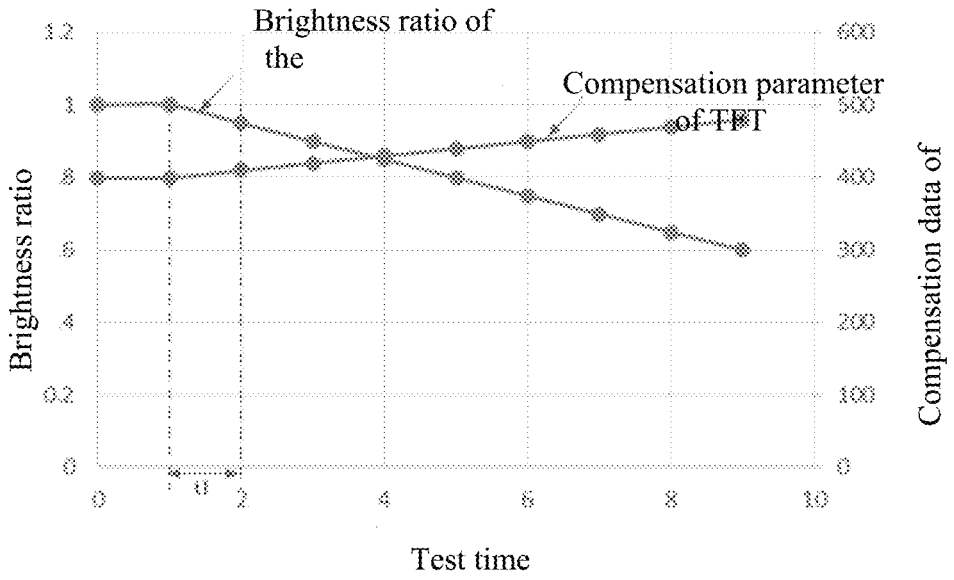
FIG. 8 is a diagram illustrating a relationship between a brightness ratio of an electroluminescent diode and TFT compensation parameters according to some embodiments of the present disclosure.

Specifically, a brightness uniformity compensation model can be constructed as shown in FIG. 8 based on the above measured first compensation parameters VGS1t0, VGS1t1, . . . , and VGS1tn and the second compensation parameters VGS2t0, VGS2t1, . . . , and VGS2tn, the brightness ratios Lt0, Lt1, . . . , and Ltn, and the corresponding accumulative lighting times 0, t1, . . . , and n*t1 of the display screen.

It should be noted that the first compensation parameter VGS1 and the second compensation parameter VGS2 appear in pairs and change with the aging of the TFT, and have the same change rules. Therefore, the TFT compensation parameter curve shown in FIG. 8 can be used to represent the VGS1 and VGS2 compensation parameters. The values of the TFT compensation parameters range from 0 to 1023.

Further, when performing uniformity compensation on the brightness of the display screen, the first compensation parameter and the second compensation parameter required for compensating the TFT during electrical compensation can be acquired by the driver chip shown in FIG. 3, the current brightness ratio can be obtained by invoking the brightness uniformity compensation model based on the first compensation parameter and the second compensation parameter required for compensating the TFT, and then the brightness ratio L of the measured display screen is compensated for based on the obtained current brightness ratio to perform brightness compensation on the display screen.

It should be noted that the brightness uniformity compensation method of the electroluminescent display screen according to the embodiments of the present disclosure can be applied to an OLED (Organic Light Emitting Diode) display screen, such as an AMOLED (Active-matrix Organic Light Emitting Diode), and can also be applied to QLED (Quantum Light Emitting Diode) display screen, which are not limited herein.

To sum up, the brightness uniformity compensation method of the electroluminescent display screen according to the embodiments of the present disclosure firstly causes the display screen to be aged under the electrical compensation state, detects and records a first compensation parameter and a second compensation parameter of each sub-pixel in the display screen every first preset time, measures and records a brightness ratio of the display screen after the electrical compensation is performed, establishes a correspondence between the first compensation parameter and the second compensation parameter and the brightness ratio, and finally when performing uniformity compensation on the display screen, obtains a corresponding brightness ratio based on the detected first compensation parameter and second compensation parameter required for compensating the TFT during the electrical compensation, and compensates for the measured current brightness ratio L of the electroluminescent diode of the display screen through the brightness ratio to perform uniformity compensation on the brightness of the display screen. Thus, the effectiveness of brightness uniformity compensation of the display screen may be improved, and the brightness uniformity of the display screen may be improved.

Figure 9:
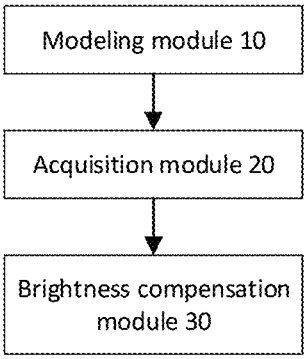
FIG. 9 is a structural block diagram of a brightness uniformity compensation system of an electroluminescent display screen according to an embodiment of the present disclosure.

FIG. 9 is a brightness uniformity compensation system of the electroluminescent display screen according to some embodiments of the present disclosure. As shown in FIG. 9, the brightness uniformity compensation system includes a modeling module 10, an acquisition module 20, and a brightness compensation module 30.

The modeling module 10 is used for performing test modeling based on a correspondence between the aging rule of the light emitting diode in the display screen and the aging rule of the thin film transistors TFT in the display screen to obtain a brightness uniformity compensation model. The acquisition module 20 is used for acquiring a first compensation parameter and a second compensation parameter required for compensating the TFT, and acquiring a current brightness ratio of the electroluminescent diode by invoking the brightness uniformity compensation model based on the first compensation parameter and the second compensation parameter required for compensating the TFT. The brightness compensation module 30 is used for performing brightness uniformity compensation on the display screen based on the acquired current brightness ratio of the electroluminescent diode.

In some examples of the present disclosure, the modeling module 10 is specifically used for constructing a brightness uniformity compensation model when an electrical compensation circuit compensates the display screen, wherein when the electrical compensation circuit performs electrical compensation on the display screen, a voltage VGS that needs to be output for each sub-pixel is calculated through the following formula (1):

$$VGS = \left(\frac{GL}{1023}\right)^{1.1}(2VGS1 - 2VGS2) + (2VGS2 - VGS1) \tag{1}$$

wherein GL is an input gray scale, and VGS1 and VGS2 are a first compensation parameter and a second compensation parameter required for electrical compensation, respectively.

Specifically, the process that the modeling module 10 constructs a brightness uniformity compensation model comprises: before an aging treatment is performed on the display screen, detecting and recording a first compensation parameter VGS1t0 and a second compensation parameter VGS2t0 of each sub-pixel in the display screen, and measuring and recording a brightness ratio Lt0 of the display screen after electrical compensation is performed; after the aging treatment is performed on the display screen, measuring and recording a brightness ratio L of the display screen every first preset time, updating the electrical compensation data to obtain a first compensation parameter VGS1tn and a second compensation parameter VGS2tn, and measuring and recording a brightness ratio Ltn of the display screen after the electrical compensation is performed based on the updated electrical compensation data; and constructing the brightness uniformity compensation model based on the first compensation parameter VGS HO and the second compensation parameter VGS2t0, the brightness ratio Lt0, the first compensation parameter VGS1tn and the second compensation parameter VGS2tn, and the brightness ratio Ltn.

Further, when performing brightness uniformity compensation on the display screen based on the acquired current brightness ratio of the electroluminescent diode, the brightness compensation module 30 compensates for the measured brightness uniformity L of the display screen based on the acquired current brightness ratio of the electroluminescent diode to perform brightness uniformity compensation on the display screen.

It should be noted that the specific implementations of the brightness uniformity compensation system of the electroluminescent display screen according to the embodiments of the present disclosure can refer to the specific embodiments of the brightness uniformity compensation method of the electroluminescent display screen described above. In order to reduce redundancy, no further descriptions are given here.

The brightness uniformity compensation system of the electroluminescent display screen of the embodiments of the present disclosure firstly performs test modeling through a modeling module based on a correspondence between the aging rule in the display screen and the aging rule of the thin film transistor TFT in the display screen, so as to obtain a brightness uniformity compensation model, then acquires a first compensation parameter and a second compensation parameter required for compensating the TFT through an acquisition module, acquires a current brightness ratio through invoking the brightness uniformity compensation model based on the first compensation parameter and the second compensation parameter required for compensating the TFT, and at last performs brightness uniformity compensation on the display screen through a brightness compensation module based on the acquired current brightness ratio of the electroluminescent diode. Thus, the effectiveness of brightness uniformity compensation of the display screen may be improved, and the brightness uniformity of the display screen may be improved.

Further, the present disclosure proposes an electroluminescent display screen including the brightness uniformity compensation system described above.

The electroluminescent display screen of the embodiment of the present disclosure may improve its own brightness uniformity compensation effect and improve its own brightness uniformity.

In the description of the present disclosure, it is to be understood that the orientations or positional relationships indicated by the terms "center", "vertical", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" and so on are orientations or positional relationships shown in the accompanying drawings, and are merely for the convenience of describing the present disclosure and simplifying the descriptions, but do not indicate or imply that the indicated devices or elements must have a particular orientation and are constructed and operated in a particular orientation, and therefore should not be construed to be limitations of the present disclosure.

Moreover, the terms "first" and "second" are used only for the purpose of description, but shall not be understood as an indication or suggestion of relative importance or implication of the number of the technical features as indicated. Hence, the features defined with "first" and "second" may include, explicitly or implicitly, at least one of the features. In the description of the present disclosure, the meaning of "plurality" is at least two, such as two, three, etc., unless specifically defined otherwise.

In the present disclosure, the terms "mount", "connect", "fix" and so on shall be understood in a broad sense unless specifically defined and limited otherwise. For example, they may be fixed connections or detachable connections, or integrated as one; and they can be mechanical connections or electrical connections; they can be directly connected or indirectly connected through an intermediary, and can be internal communication of two components or interaction between the two components unless otherwise explicitly limited. Those ordinary skilled in the art can understand the specific meanings of the above terms in the present disclosure based on specific circumstances.

In the present disclosure, unless specifically defined and limited otherwise, the first feature being "above" or "below" the second feature may be that the first and second features are in direct contact, or that the first and second features are in indirect contact through an intermediary. And the first feature being "above", "over" and "on" the second feature may be that the first feature is right above or obliquely above the second feature, or merely indicates that the first feature is higher in height than the second feature. And the first feature being "below", "underneath" and "under" the second feature may be that the first feature is right below or obliquely below the second feature, or merely indicates that the first feature is less in height than the second feature.

In the descriptions of the present specification, the terms "one embodiment", "some embodiments", "an example", "a specific example", or "some examples" or the like mean that specific features, structures, materials or characteristics described in combination with the embodiment or example are included in at least one embodiment or example of the present disclosure. In this specification, the schematic representations of the above terms do not necessarily refer to the same embodiment or example. Furthermore, the specific features, structures, materials, or characteristics described may be combined in any suitable manner in any one or more of the embodiments or examples. In addition, those skilled in the art may combine and assemble different embodiments or examples and features of different embodiments or examples described in this specification without conflicting with each other.

Although embodiments of the present disclosure have been shown and described above, it should be understood that the above embodiments are exemplary and should not be construed as limiting the present disclosure, and those ordinary skilled in the art may change, modify, replace and deform the above embodiments within the scope of the present disclosure.

The invention claimed is:

1. A brightness uniformity compensation method of an electroluminescent display screen, the brightness uniformity compensation method comprising:

performing test modeling based on a correspondence between an aging rule of an electroluminescent diode in the display screen and an aging rule of a thin film transistor (TFT) in the display screen to construct a brightness uniformity compensation model;

acquiring a first compensation parameter and a second compensation parameter required for compensating the TFT, and acquiring a current brightness ratio of the electroluminescent diode by invoking the brightness uniformity compensation model based on the first compensation parameter and the second compensation parameter required for compensating the TFT; and performing brightness uniformity compensation on the display screen based on the acquired current brightness ratio of the electroluminescent diode.

2. The brightness uniformity compensation method according to claim 1, wherein an aging treatment is performed on the display screen in a state of performing electrical compensation on the display screen to constructing the brightness uniformity compensation model, wherein process of constructing the brightness uniformity compensation model comprises:

before the aging treatment is performed on the display screen, detecting and recording a first compensation parameter VGS HO and a second compensation parameter VGS2t0 of each sub-pixel in the display screen, and measuring and recording a brightness ratio Lt0 of the display screen after the electrical compensation is performed;

after the aging treatment is performed on the display screen, measuring and recording a brightness ratio L of the display screen every first preset time, updating electrical compensation data to obtain a first compensation parameter VGS1tn and a second compensation parameter VGS2tn, and measuring and recording a brightness ratio Ltn of the display screen after electrical compensation is performed based on the updated electrical compensation data; and constructing the brightness uniformity compensation model based on the first compensation parameter VGS HO and the second compensation parameter VGS2t0, the brightness ratio Lt0, the first compensation parameter VGS1tn and the second compensation parameter VGS2tn, and the brightness ratio Ltn, where n is an integer greater than or equal to 1.

3. The brightness uniformity compensation method according to claim 2, wherein performing brightness uniformity compensation on the display screen based on the acquired current brightness ratio of the electroluminescent diode comprises:

compensating for the measured brightness L of the display screen based on the acquired current brightness ratio of the electroluminescent diode to perform brightness uniformity compensation on the display screen.

4. The brightness uniformity compensation method according to claim 2, wherein when performing electrical compensation on the display screen, a voltage VGS that needs to be output for each sub-pixel is calculated by following formula:

$$VGS = \left(\frac{GL}{1023}\right)^{1.1}(2VGS1 - 2VGS2) + (2VGS2 - VGS1)$$

wherein GL is an input gray scale, and VGS1 and VGS2 are the first compensation parameter and the second compensation parameter respectively required for electrical compensation.

5. The brightness uniformity compensation method according to claim 3, wherein when performing electrical compensation on the display screen, a voltage VGS that needs to be output for each sub-pixel is calculated by following formula:

$$VGS = \left(\frac{GL}{1023}\right)^{1.1}(2VGS1 - 2VGS2) + (2VGS2 - VGS1)$$

wherein GL is an input gray scale, and VGS1 and VGS2 are the first compensation parameter and the second compensation parameter respectively required for electrical compensation.

* * * * *